US007591466B2

(12) United States Patent
Kyburz

(10) Patent No.: US 7,591,466 B2
(45) Date of Patent: Sep. 22, 2009

(54) DEVICE FOR TRANSFERRING PRINT PRODUCTS, CONVEYED WHILE SUSPENDED FROM SPACED-APART CLAMPS ON A CIRCULATING CONVEYING ELEMENT

(75) Inventor: Rudolf Kyburz, Ofringen (CH)

(73) Assignee: Müller Martini Holding AG, Hergiswil (CH)

( * ) Notice: Subject to any disclaimer, the term of this patent is extended or adjusted under 35 U.S.C. 154(b) by 10 days.

(21) Appl. No.: 11/717,681

(22) Filed: Mar. 14, 2007

(65) Prior Publication Data

US 2007/0216086 A1 Sep. 20, 2007

(30) Foreign Application Priority Data

Mar. 14, 2006 (EP) ..... 06405113

(51) Int. Cl.
*B65H 29/04* (2006.01)

(52) U.S. Cl. ..... 271/204; 271/69; 271/306; 271/277; 101/232; 101/408; 101/407.1

(58) Field of Classification Search ..... 271/204, 271/179, 69; 101/232, 408
See application file for complete search history.

(56) References Cited

U.S. PATENT DOCUMENTS 5,169,139 A 12/1992 Stauber et al.
5,462,266 A * 10/1995 Meier ..... 270/52.16
5,596,932 A 1/1997 Honegger et al.
6,976,674 B2 * 12/2005 Honegger ..... 271/204
7,318,587 B2 * 1/2008 Hansch ..... 271/204
2002/0175044 A1 11/2002 Muller et al.
2005/0133986 A1 6/2005 Hansch

FOREIGN PATENT DOCUMENTS

EP 0 380 921 A 8/1990

OTHER PUBLICATIONS

European Search Report dated Aug. 4, 2006, issued in connection with EP 06405113.9.

* cited by examiner

*Primary Examiner*—Patrick H Mackey
*Assistant Examiner*—Luis Gonzalez
(74) *Attorney, Agent, or Firm*—Venable LLP; Robert Kinberg; Steven J. Schwarz

(57) ABSTRACT

A device for transferring print products comprises a circulating conveying element that includes clamps. A conveyor moves approximately in the same direction and synchronously below the conveying element, which includes grippers. A guide arrangement is provided in a transfer segment where the print products are transferred from the circulating conveying element to the conveyor. The guide arrangement includes spiral rotors having spiral sections respectively extending from opposite sides into spaces between the print products and which are effective in the conveying direction to stably position the print products. Activation devices operatively are arranged to open the clamps and close the grippers to effect the transfer of the print products from one of the clamps on the circulating conveying element to one of the grippers on the conveyor.

14 Claims, 2 Drawing Sheets

DEVICE FOR TRANSFERRING PRINT PRODUCTS, CONVEYED WHILE SUSPENDED FROM SPACED-APART CLAMPS ON A CIRCULATING CONVEYING ELEMENT

CROSS-REFERENCE TO RELATED APPLICATION

This application claims the priority of European Patent Application No. 06405113.9-2314, filed on Mar. 14, 2006, the subject matter of which is incorporated herein by reference.

BACKGROUND

The invention relates to a device for transferring print products, conveyed along a conveying path while suspended transverse to the conveying direction from spaced-apart clamps on a circulating conveying element, to a conveyor that is driven synchronously below the conveying element, in the same direction, and is provided at regular intervals with grippers. The invention furthermore relates to a guide arrangement for accompanying the print products along a transfer segment, as well as to activation devices for opening the clamps and closing the grippers.

Reference EP 0 380 921 A2 discloses a device for taking over printed sheets that are conveyed in a first direction while suspended from a first conveying system, and for transferring these printed sheets to a second conveying system, which individually takes over the sheets and conveys these in a second direction. To ensure an uninterrupted takeover and transfer of the printed sheets, a wheel is provided between the conveying systems. The wheel is embodied with compartments that can be opened and closed for accommodating the printed sheets, wherein the printed sheets are transferred to the second conveying system only after being turned.

The company Druck-und Verlag, Neu-Isenburg, Germany, has been producing print products such as newspapers, magazines and the like since 1989, using an inserting machine, model number EM 40, sold by the Müller Martini Group. In the EM 40 machine, a delivery conveyor is used to remove the print products from the operation. For stabilizing and positioning the flat print products, which are held suspended inside the delivery conveyor, guide elements, that move along in conveying direction, are introduced into the conveying flow, during a specified segment of the conveying path, so that the print products are guided along this segment by the aforementioned guide elements in such a way that they occupy a defined, stable position at one location.

SUMMARY

It is an object of the present invention to provide a different solution for the defined problem of obtaining a stable positioning of the print products that are conveyed in a flow, so that the latter can be transferred with the aid of a circulating conveying element to grippers mounted on a conveyor.

The above and other objects are accomplished wherein, according to one embodiment of the invention, there is provided a device for transferring print products conveyed along a conveying path in a conveying direction, comprising: a circulating conveying element including spaced apart clamps to suspend the print products transverse to the conveying direction; a conveyor driven to move approximately in the same direction and synchronously below the conveying element, the conveyor including grippers spaced at regular intervals; a guide arrangement disposed along a transfer segment in which the print products are transferred from the circulating conveying element to the conveyor, the guide arrangement accompanying the print products along the transfer segment and including spiral rotors having spiral sections which respectively extend from opposite sides into spaces between the print products resulting from the spacing of the clamps on the conveying element, wherein the spiral sections are effective in the conveying direction to stably position the print products; and activation devices operatively arranged to open the clamps and close the grippers to effect the transfer in the transfer segment of a respective one of the print products from one of the clamps on the circulating conveying element to one of the grippers on the conveyor.

Thus according to the invention, the guide arrangement utilizes spiral sections of a spiral-type rotor, wherein these sections are effective in the conveying direction, respectively extending from the side into the spaces between print products that are formed by the spacing of the clamps on the conveying element. With the aid of this structural measure, a precise and careful transfer of the print products can be realized.

BRIEF DESCRIPTION OF THE DRAWINGS

These and other features and advantages of the invention will be further understood from the following detailed description of an embodiment of the invention with reference to the accompanying drawing.

DETAILED DESCRIPTION

Figure 1:
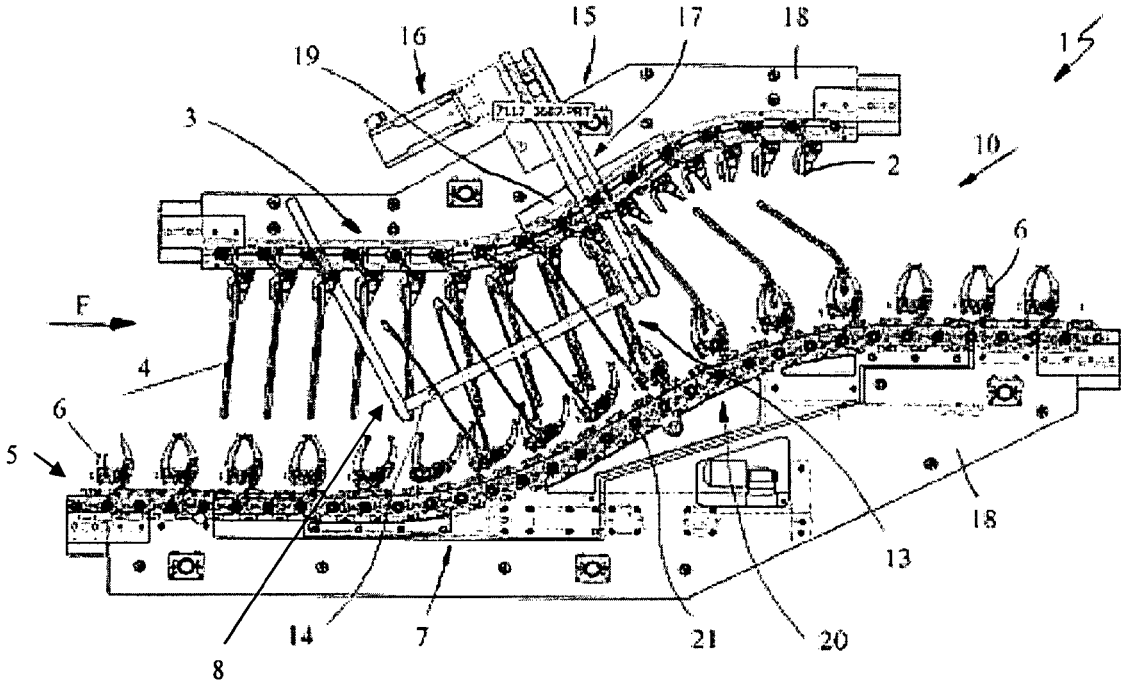
FIG. 1 depicts a view from the side of the device according to the invention.
Figure 2:
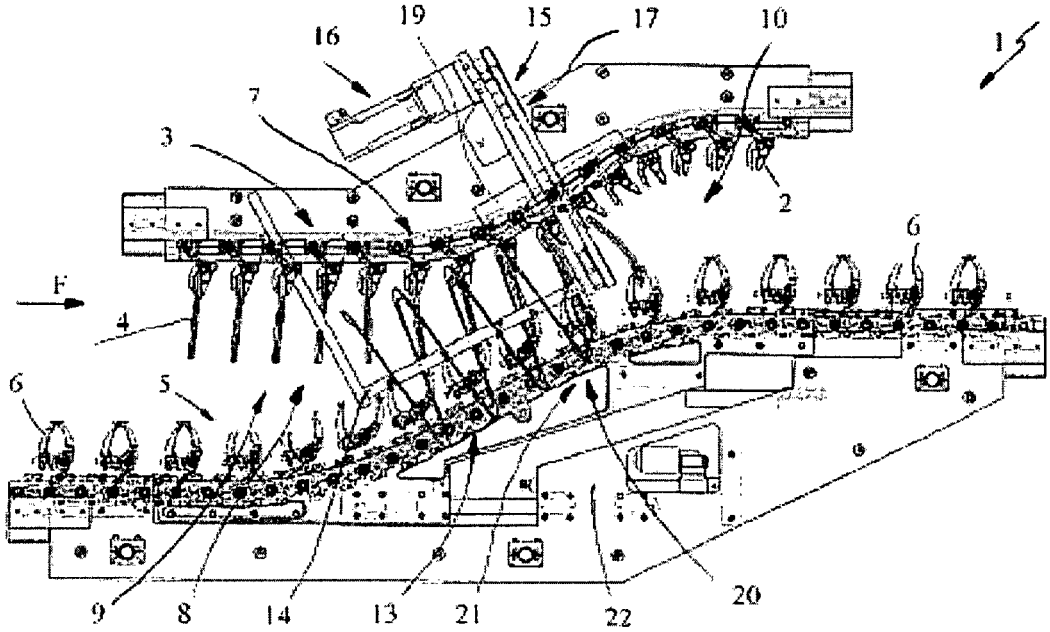
FIG. 2 depicts the device shown in FIG. 1 in a different processing position.

FIGS. 1 and 2 show a device 1 for transferring print products 4, conveyed along a conveying path while suspended transverse to the conveying direction F from spaced-apart clamps 2 on a circulating conveying element 3. A conveyor 5, located underneath the conveying element 3, moving at approximately the same speed in a transfer segment 7, is provided at regular intervals with grippers 6 for taking over the print products 4 from the clamps 2. The transfer segment 7 is formed by a guide arrangement 8, discussed below, which moves the conveyed print products 4 to a position for transfer, before they are transferred from the clamps 2 to the grippers 6, and maintains these products in a stable position. In a feed-in area 9 of transfer segment 7, the conveying element 3 and the conveyor 5 move along an upwardly slanted path, from an approximately horizontal path, as seen in conveying direction F, such that the conveying element 3 and the conveyor 5 move continuously toward each other. The conveying element 3 and the conveyor 5, respectively, traverse a curved track towards a discharge region 10 of transfer segment 7. In the discharge region 10, the conveyor 5 continues to move approximately in the horizontal direction, whereas the conveying element 3 in the discharge region 10 may move in the horizontal or upward direction.

Figure 3:
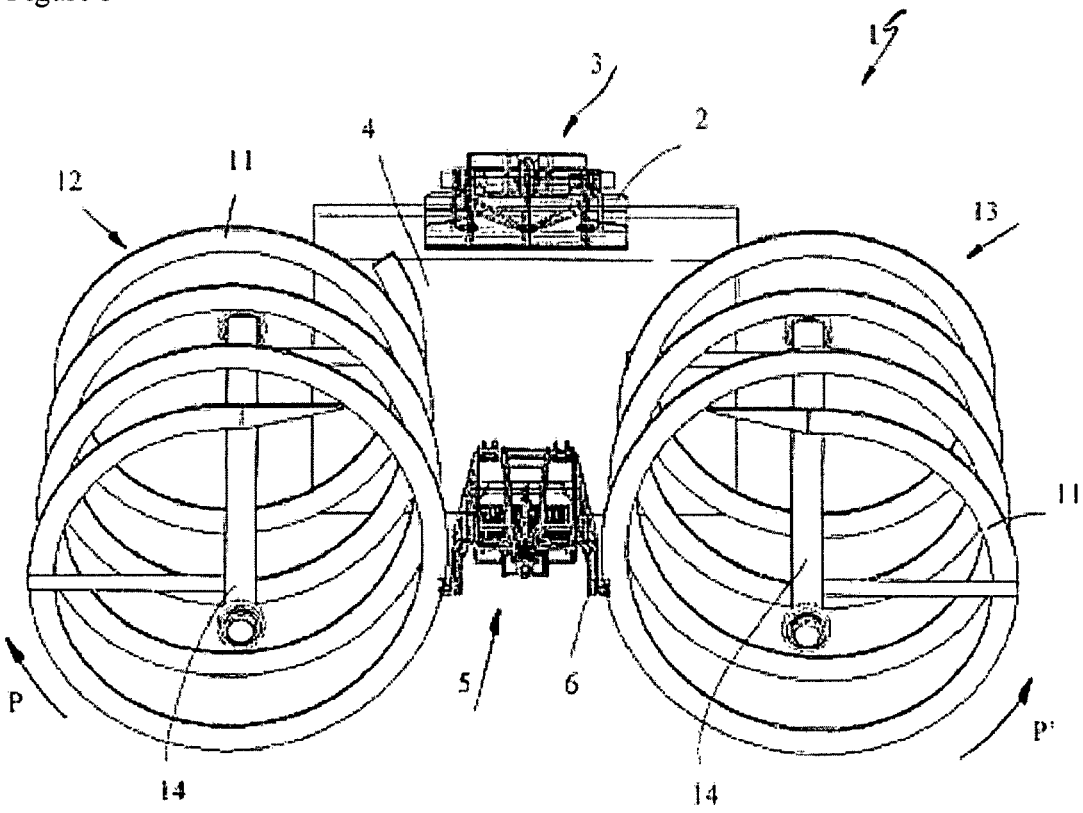
FIG. 3 depicts a view of the device shown in FIG. 1 along directional arrow F.

Referring to FIGS. 1-3, the guide arrangement 8 is arranged on both sides of the flow of the conveying print products 4 and is located in the upward sloping portion of transfer segment 7. The guide arrangement 8, see FIG. 3, comprises two spiral-type rotors 12, 13 each having a plurality of spiral sections 11 that are supported by a shaft 14. The spiral-type rotors are arranged on both sides of the print products 4, being conveyed on conveying element 3, and are effective in conveying direction F and extend into the spaces between the print products 4, formed by the spaces between two clamps 2. The first spiral section 11 of a rotor 12, 13, as determined by the conveying direction, extends into a space, formed in the conveyed flow by two clamps 2, behind one print product 4 held by a clamp 2 of the conveying element 3. As the spiral-type rotors 12, 13 rotate, the first spiral section is subsequently accompanied by the remaining spiral sections, so as to finally support the print products 4 in a defined transfer position. Once a transfer position is reached, the print product 4 is gripped for the transfer by the assigned gripper 6 of the conveyor 5 and is released immediately thereafter by the clamp 2 of the conveying element 3. As seen in conveying direction F of the print products 4, the spiral-type rotors 12, 13 rotate in opposite directions, see P and P' in FIG. 3, so that their exposed back ends extend into a clearance space between two print products 4. The shaft 14 forms the upward-sloping axis of rotation for the spiral-type rotors 12, 13, as seen in the conveying direction F.

Figure 4:
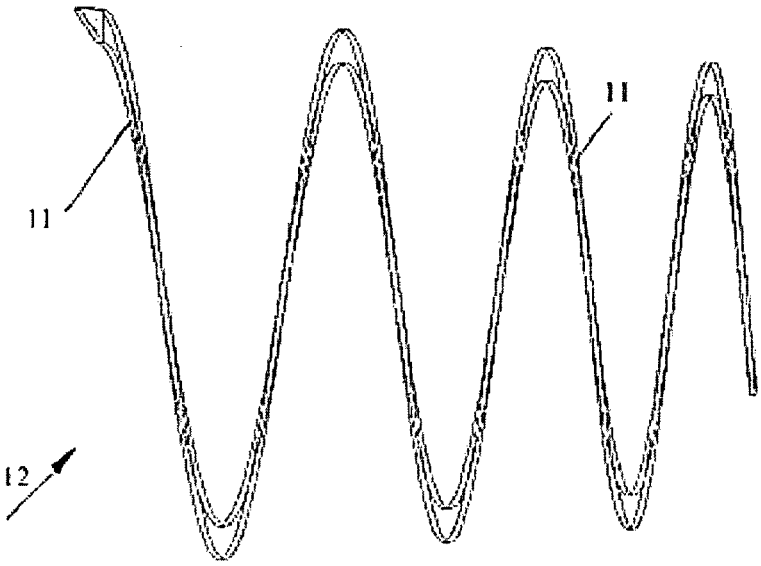
FIG. 4 depicts a view of the guide arrangement shown in FIGS. 1 to 3 from the side.

In FIG. 4, with increasing length and accompanying distance, the spiral sections 11 of the rotors 12, 13 are tapered in the shape of a truncated cone. In the same way, the pitch for the spiral sections 11 decreases in the conveying direction F of the print products 4. The spiral sections 11 of the rotors 12, 13 can be formed from spring steel, spring wire, or plastic. The spacing between the rotors may also be adjusted.

FIGS. 1 and 2 also illustrate a driving arrangement 15, consisting of a geared motor 16, which is connected via a toothed belt gearing 17 to the shaft 14. The driving arrangement 15 and the rotor 12, 13 are mounted on a frame 18 of the device 1. Activation devices 19, 20 are provided for operating the clamps 2 on the conveying element 3 and the grippers 6 on the conveyor 5, wherein the conveying element 3 and the conveyor 5 must move with coordinated speeds, at least along the transfer segment 7, so that the grippers 6 can be closed and the clamps 2 of the conveying element 3 can be opened with the aid of the activation devices 20, 19. For the transfer of print products 4 with differing format sizes, e.g. with differently long legs, the upward sloping guide section on the transfer segment 7 is designed to be displaceable, so that differently dimensioned print products 4 can be transferred from the conveying element 3 to the conveyor 5 by adjusting this guide section. A form-locking guide 21 is arranged for this on the transfer segment 7 of the conveyor 5 so that it can be displaced. FIG. 1 shows this guide 21 in a position where it is adjusted for print products 4 having longer legs than those shown in FIG. 2. FIG. 2 shows an extended-out piston-cylinder unit 22, by which the guide 21 is displaced to the left in the transfer segment 7, so that the distance between conveying element 3 and conveyor 5 is shorter in the transfer segment 7 than in FIG. 1. Typically, the conveyor 5 operates at a faster speed than the conveying element 3 because the clamps 2 on the conveying element 3 are spaced closer together than the grippers 6 of the conveyor 5.

The invention has been described in detail with respect to preferred embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

What is claimed is:

1. A device for transferring print products conveyed along a conveying path in a conveying direction, comprising:

a circulating conveying element including spaced apart clamps to suspend the print products transverse to the conveying direction;

a conveyor driven to move approximately in the same direction and synchronously below the conveying element, the conveyor including grippers spaced at regular intervals;

a guide arrangement disposed along a transfer segment in which the print products are transferred from the circulating conveying element to the conveyor, the guide arrangement accompanying the print products along the transfer segment and including spiral rotors having spiral sections which respectively extend from opposite sides into spaces between the print products resulting from the spacing of the clamps on the conveying element, wherein the spiral sections are effective in the conveying direction to stably position the print products; and activation devices operatively arranged to open the clamps and close the grippers to effect the transfer in the transfer segment of a respective one of the print products from one of the clamps on the circulating conveying element to one of the grippers on the conveyor, wherein the conveying element and the conveyor change direction and move upward in an intake region of the transfer segment, as seen in the conveying direction, so that the conveying element and the conveyor continuously move toward each other.

2. The device according to claim 1, wherein the conveyor follows a curved path in the transfer segment.

3. The device according to claim 2, wherein the conveyor moves in a substantially horizontal direction in a discharge region of the transfer segment.

4. A device for transferring print products conveyed along a conveying path in a conveying direction, comprising:

a circulating conveying element including spaced apart clamps to suspend the print products transverse to the conveying direction;

a conveyor driven to move approximately in the same direction and synchronously below the conveying element, the conveyor including grippers spaced at regular intervals;

a guide arrangement disposed along a transfer segment in which the print products are transferred from the circulating conveying element to the conveyor, the guide arrangement accompanying the print products along the transfer segment and including spiral rotors having spiral sections which respectively extend from opposite sides into spaces between the print products resulting from the spacing of the clamps on the conveying element, wherein the spiral sections are effective in the conveying direction to stably position the print products; and activation devices operatively arranged to open the clamps and close the grippers to effect the transfer in the transfer segment of a respective one of the print products from one of the clamps on the circulating conveying element to one of the grippers on the conveyor, wherein each spiral rotor has a diameter that continues in a cone shape, as seen in conveying direction.

5. A device for transferring print products conveyed along a conveying path in a conveying direction, comprising:

a circulating conveying element including spaced apart clamps to suspend the print products transverse to the conveying direction;

a conveyor driven to move approximately in the same direction and synchronously below the conveying element, the conveyor including grippers spaced at regular intervals;

a guide arrangement disposed along a transfer segment in which the print products are transferred from the circulating conveying element to the conveyor, the guide arrangement accompanying the print products along the transfer segment and including spiral rotors having spiral sections which respectively extend from opposite sides into spaces between the print products resulting from the spacing of the clamps on the conveying element, wherein the spiral sections are effective in the conveying direction to stably position the print products; and activation devices operatively arranged to open the clamps and close the grippers to effect the transfer in the transfer segment of a respective one of the print products from one of the clamps on the circulating conveying element to one of the grippers on the conveyor, wherein the spiral sections of each rotor have a decreasing pitch as seen in the conveying direction of the print products.

6. The device according to claim 1, wherein each spiral rotor includes a drive shaft having an axis of rotation that slopes in an upward direction, as seen in the conveying direction.

7. The device according to claim 1, wherein the spiral rotors are driven in opposite directions and are arranged so that the spacing between them is adjustable.

8. The device according to claim 1, further including a driving arrangement to which the spiral rotors are drive-connected.

9. The device according to claim 1, wherein the activation devices are arranged in the transfer segment.

10. The device according to claim 1, wherein a distance between the conveying element and the conveyor is adjustable in the transfer segment.

11. The device according to claim 10, wherein at least the conveyor includes section that is upward sloping in the transfer segment and that is adjustable to change the spacing between the conveying element and the conveyor in the transfer segment.

12. The device according to claim 11, wherein the section of the conveyor is arranged to be displaceable in a longitudinal direction in the transfer segment.

13. The device according to claim 1, wherein the spacing between the clamps on the conveying element is less than the spacing between the grippers on the conveyor.

14. The device according to claim 13, wherein the conveyor operates at a faster conveying speed than the conveying element.

* * * * *